US007416152B2

(12) United States Patent
Wieser et al.

(10) Patent No.: US 7,416,152 B2
(45) Date of Patent: Aug. 26, 2008

(54) DUAL-MOUNT ROLL DISPENSER

(75) Inventors: Russell Wieser, Appleton, WI (US); John S. Formon, Appleton, WI (US); Darrin Kittelson, San Antonio, TX (US)

(73) Assignee: SCA Tissue North America LLC, Philadelphia, PA (US)

( * ) Notice: Subject to any disclaimer, the term of this patent is extended or adjusted under 35 U.S.C. 154(b) by 0 days.

(21) Appl. No.: 11/227,066

(22) Filed: Sep. 16, 2005

(65) Prior Publication Data

US 2006/0102769 A1 May 18, 2006

Related U.S. Application Data

(63) Continuation of application No. PCT/US2004/037742, filed on Nov. 12, 2004.

(51) Int. Cl.
*B65H 18/04* (2006.01)

(52) U.S. Cl. ..... 242/598.5; 242/560; 242/564.1

(58) Field of Classification Search ..... 242/590, 242/598.5, 560, 560.2, 564, 564.1, 564.2, 242/565; D6/518, 522, 523
See application file for complete search history.

(56) References Cited

U.S. PATENT DOCUMENTS

| | | | | | |
|---|---|---|---|---|---|
| 2,626,761 | A | * | 1/1953 | Simpson et al. | |
| 2,873,158 | A | * | 2/1959 | Pinkham, Jr. | 312/34.24 |
| 2,932,463 | A | * | 4/1960 | Mau | 242/564.5 |
| 3,058,682 | A | * | 10/1962 | Mott et al. | 242/560.3 |
| 4,444,359 | A | * | 4/1984 | Butler | 242/598.6 |
| D293,750 | S | | 1/1988 | Leotta | |
| D312,369 | S | * | 11/1990 | De Luca et al. | D6/522 |
| D332,366 | S | * | 1/1993 | Hines | D6/523 |
| D332,542 | S | | 1/1993 | Hines | |
| D337,679 | S | * | 7/1993 | Guigiaro | D6/518 |
| D441,231 | S | * | 5/2001 | Purcell et al. | D6/522 |
| D450,500 | S | * | 11/2001 | Andersson | D6/518 |
| 6,591,727 | B1 | * | 7/2003 | Purcell et al. | |
| 6,902,134 | B2 | | 6/2005 | Green et al. | |

FOREIGN PATENT DOCUMENTS

| | | |
|---|---|---|
| WO | WO 97/11630 | 4/1997 |

* cited by examiner

*Primary Examiner*—William A Rivera
(74) *Attorney, Agent, or Firm*—Young & Thompson

(57) ABSTRACT

A dual-mount roll dispenser has a cover and a body. The body portion is adapted for recess mounting but is also suitable to be exposed in a wall mount application. The hinge or pivots that permit the cover to be opened are positioned sufficiently far forward that, together with the shape of the cover, the cover can be opened wide even when more than half the depth of the dispenser is recessed with a surrounding wall.

10 Claims, 5 Drawing Sheets

DUAL-MOUNT ROLL DISPENSER

CROSS REFERENCE TO RELATED APPLICATIONS

This application is a continuation of International Application No. PCT/US2004/037742 filed on Nov. 12, 2004, which designated the United States of America, the entire contents of which are hereby incorporated by reference.

BACKGROUND OF THE INVENTION

1. Field of the Invention

The invention relates to a dispenser for absorbent sheet products contained in roll form within a dispenser body, preferably paper towels.

2. Description of Related Art

Paper towel dispensers in which the towels are supplied in roll form are widely used in commercial establishments and have the advantage of relatively high capacity, and thus a less frequent need to replace the rolls. Most commercial paper towel rolls are eight inches in diameters, with other's being six inches. Therefore, most roll dispensers, if mounted on a wall, will project outward from the wall in excess of eight inches, taking into account that the surrounding housing structure will be at least slightly deeper than the diameter of the paper roll contained therein.

On the other hand, the Americans with Disabilities Act (ADA) mandates that when a building or facility is under construction or undergoing significant alterations strict guidelines must be observed to ensure that it is accessible to and usable by individuals with disabilities. In particular, buildings and facilities must follow the ADA Accessibility Guidelines for Buildings and Facilities (ADAAG) which, among a variety of other requirements, specify that no objects may protrude beyond four inches in the space between 27 and 80 inches above the walking surface along a walkway, corridor or other path of travel, unless a lower-lying structure is provided that will serve as a cane stop to alert an approaching visually impaired individual.

Roll dispensers in public facilities might be regarded as being along a "path of travel" when installed in public restrooms or the like, and there is therefore a demand for roll dispensers that are ADA-compliant, in that they project no more than four inches from the wall on which they are mounted. This requires the dispenser to be recessed with the wall by four or more inches, or recessed within an in-built cabinet in the wall. Certain roll dispenser suppliers provide specially designed dispensers made to be recess-mounted, which requires them to design and stock another product in addition to their wall-mounted roll dispenser. Such recess-specific dispensers are unsuitable for wall mounting (i.e., not recessed mounting), because the structure intended to be received within the wall is made of stamped metal that has a variety of sharp edges and abrupt protuberances, which are unacceptable for safety reasons within publicly accessible spaces.

SUMMARY OF THE INVENTION

It is therefore an object of the invention to address and alleviate, at least in part, the disadvantages described above in connection with the prior art, by providing a dual-mount roll dispenser comprising a dispenser body and a cover; the dispenser body comprising a rear portion comprising top, bottom and side surfaces and a rear mounting surface, the rear portion being adapted to at least partially receive a roll of absorbent sheet products to be disposed within the dispenser, such a roll having a diameter of at least about six inches, the dispenser body further comprising a flange along at least one of the top, bottom and side surfaces of the rear portion, the flange projecting outwardly from the rear portion, a first hinge structure and a first lock structure; the cover comprising a second hinge structure engaging the first hinge structure to secure the cover to the dispenser body while permitting the cover to be opened for service of the dispenser or replacement of a roll of absorbent sheet products therein, and a second lock structure adapted to engage the first lock structure to secure the cover in a closed position with at least one edge of the cover contacting the flange, wherein the cover has a horizontal projection not exceeding about four inches when the cover is closed and when the dispenser is oriented with the rear mounting surface disposed vertically, the top, bottom and side surfaces of the rear portion of the dispenser body being outwardly free of sharp edges.

BRIEF DESCRIPTION OF THE DRAWINGS

Other objects, features and advantages of the invention will become more apparent after reading the following detailed-description of preferred embodiments of the invention, given with reference to the accompanying drawings, in which.

DETAILED DESCRIPTION OF PREFERRED EMBODIMENTS

Figure 1:
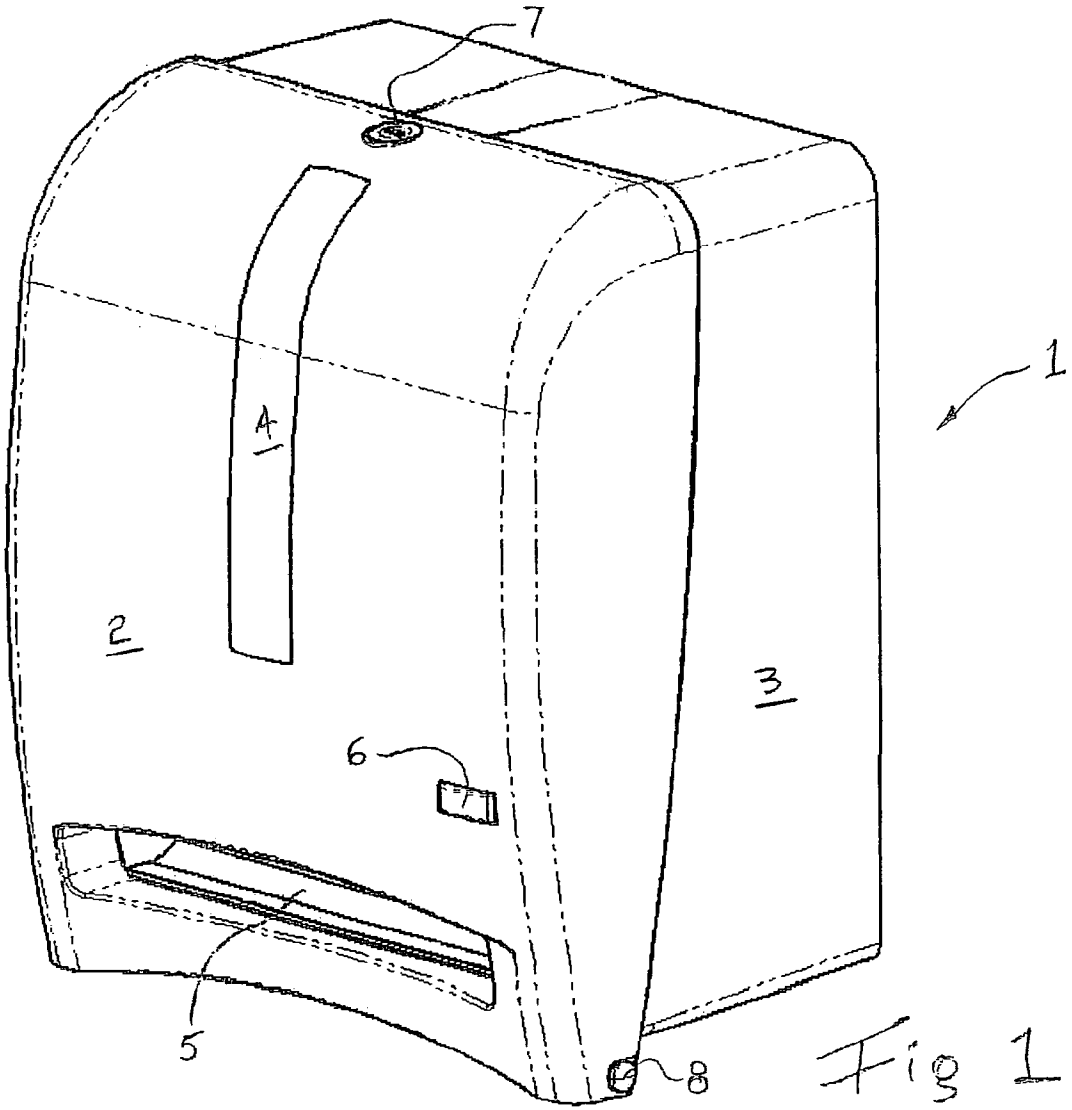
FIG. 1 is a perspective view showing an embodiment of a dispenser according to the present invention.

In FIG. 1, it can be seen that the dispenser 1 comprises a cover 2 and a body portion 3. The cover 2 is pivotally mounted to the body portion 3 via pivot pins 8 that pass through complementary aligned openings in the cover 2 and body portion 3, although another hinge type or other pivotal mounting structure could also be used. The term "hinge structure" is used broadly in this specification and claims to designate any structure that allows the cover to be pivotally mounted to the cover. The cooperating hinge structures could also take the form of bosses formed on the dispenser body that fit within openings formed on the cover.

With the cover closed as shown in FIG. 1, it is held in place by a lock 7, which involves a conventional locking structure engaging with a cooperating locking structure (element 17 in FIG. 2) on the body portion 3.

Cover 2 includes a dispensing opening 5, a transparent window 4, and a sensor indicator 6. In the depicted embodiment, the dispenser is a powered hands-free dispenser, of the type in which a sensor disposed behind the sensor indicator 6 detects the presence of a user's hand, and in response to that detection automatically dispenses a predetermined or adjustable length of paper towel, which the user then tears off by pulling the towel against the cutting blade disposed inside the dispenser housing. The type of sensing is not limited in this invention, and could be for example passive or active infrared sensing, or capacitive proximity sensing.

However, the invention can also be embodied in roll dispensers of other types, for example the so-called "hands-free mechanical" type of dispenser, in which the user provides the dispensing power by pulling the next sheet out of the dispenser by its protruding tail; as well as roll dispensers in which the user causes the roll to dispenses by actuating a mechanical lever or the like.

The roll of absorbent sheet material to be dispensed from the dispenser may either be a continuous imperforate roll, which is detached from the roll by the user pulling the dispensed sheet against a cutting blade, or may instead be a partially pre-cut web in which the force of the user pulling on the dispensed sheet serves to sever the tabs that connect the dispensed sheet to the next sheet to be dispensed, as is common in hands-free mechanical dispensers. Those pre-cuts can be made either during manufacturing converting of the roll, or in-situ by a blade in the dispenser that pre-cuts the tail of the sheet as it is being dispensed.

The term Aabsorbent sheet products@ as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

Cover 2 is mainly opaque or translucent, except in the area of the window 4, which is transparent. Cover 2 and body portion 3 are both preferably made by injection molding of plastic, and it is preferred that the cover 2 with its window 4 be formed by two-shot injection molding so as to enhance the structural integrity of the window 4 within the cover 2.

The body portion 3 comprises a rear portion that is in this embodiment generally parallelepiped, in that the side surfaces are generally parallel to one another, the top and bottom surfaces are generally parallel to each other, the top and bottom surfaces are generally perpendicular to the side surfaces, and the rear mounting surface is generally perpendicular to the top, bottom and side surfaces. This structure facilitates a recessed mounting in an orthogonal wall cut-out or framing rough-in. The outward corners of this rear portion are nevertheless rounded, and the rear portion is otherwise free of sharp edges or abrupt protuberances. The dispenser 1 of this embodiment is therefore uniquely suited not only for recess mounting in an ADA-compliant environment, but also for wall mounting in an environment or under conditions where the four inch restriction of the ADA does not apply.

Figure 2:
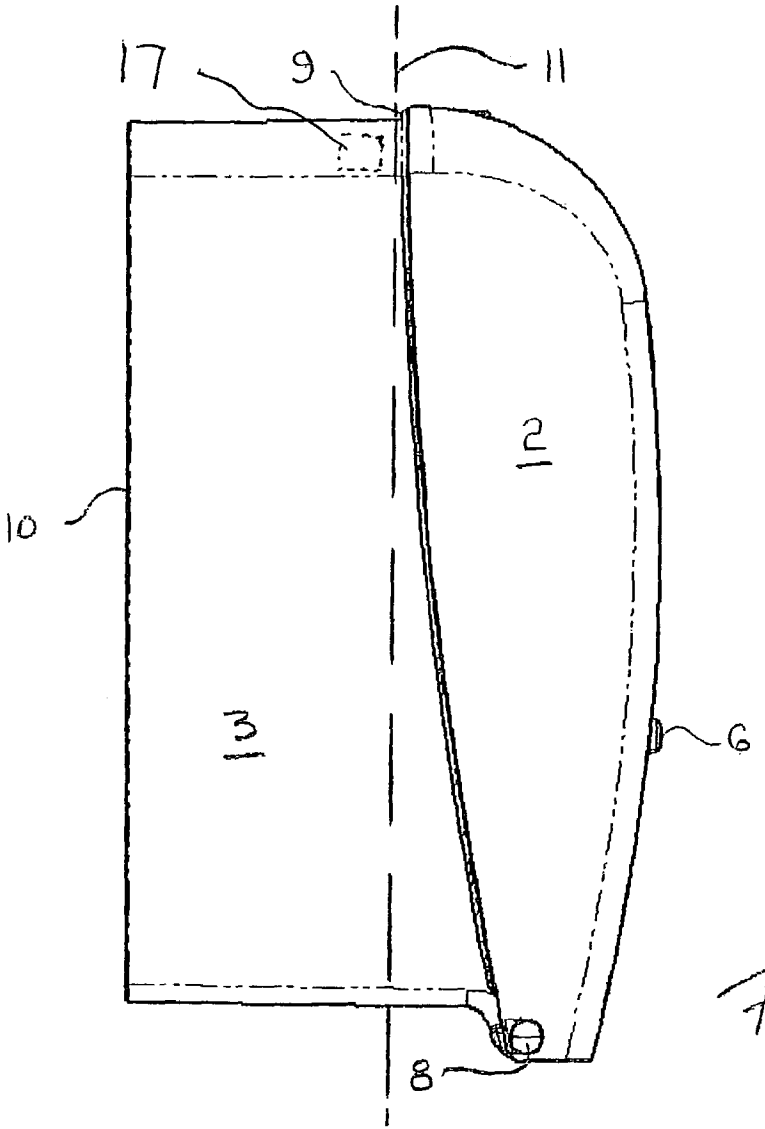
FIG. 2 is a side view showing the dispenser according to FIG. 1.

Referring now to FIG. 2, it can be seen that the cover 2 extends rearwardly of the dispenser body a greater distance at a top portion thereof than at a bottom portion thereof, such that the cover has a generally lenticular shape as viewed from the side.

The body portion 3 is formed with a flange 9 that provides a positive stop for the cover 2 when it is closed. The flange 9 in this embodiment extends along the top side of the body portion 3 and downwardly along its vertical sides; however, it is sufficient that the flange 9 extend along at least one side of the body portion 3. The portion of flange 9 extending along the top of the body portion 3 also provides a dual function of acting as a stop limiting the extent to which the dispenser body may be recessed in a recess-mounting application, with the broken line 11 in FIG. 2 signifying an outer wall surface, with the part of the dispenser to the left of the broken line 11 being recessed within a wall or cabinet structure, and the portion of the dispenser to the right of line 11 projecting from the wall surface. Thus, the horizontal projection of the cover to the right of line 11, including the thickness of the flange, taken with the rear mounting surface 10 of the body portion 3 oriented vertically as shown in FIG. 2, is not greater than four inches. To the extent that the projection is less than four inches, then in a recess mounting application the dispenser need not be recessed all the way to the flange 9.

It is also apparent in FIG. 2 that hinge structures 8 are located adjacent bottom side corners of the dispenser body and the cover, respectively. The forward location of the hinge structures, together with the shape of the lid, permits the cover to be opened a full 180° for replacement of a roll, even when the dispenser body is recess mounted to the flange 9. It is not necessary that the cover have sufficient clearance to open a full 180°, but rather that the cover be able to open far enough in a recess mount environment to permit a new roll of absorbent sheet product to be installed.

Figure 3:
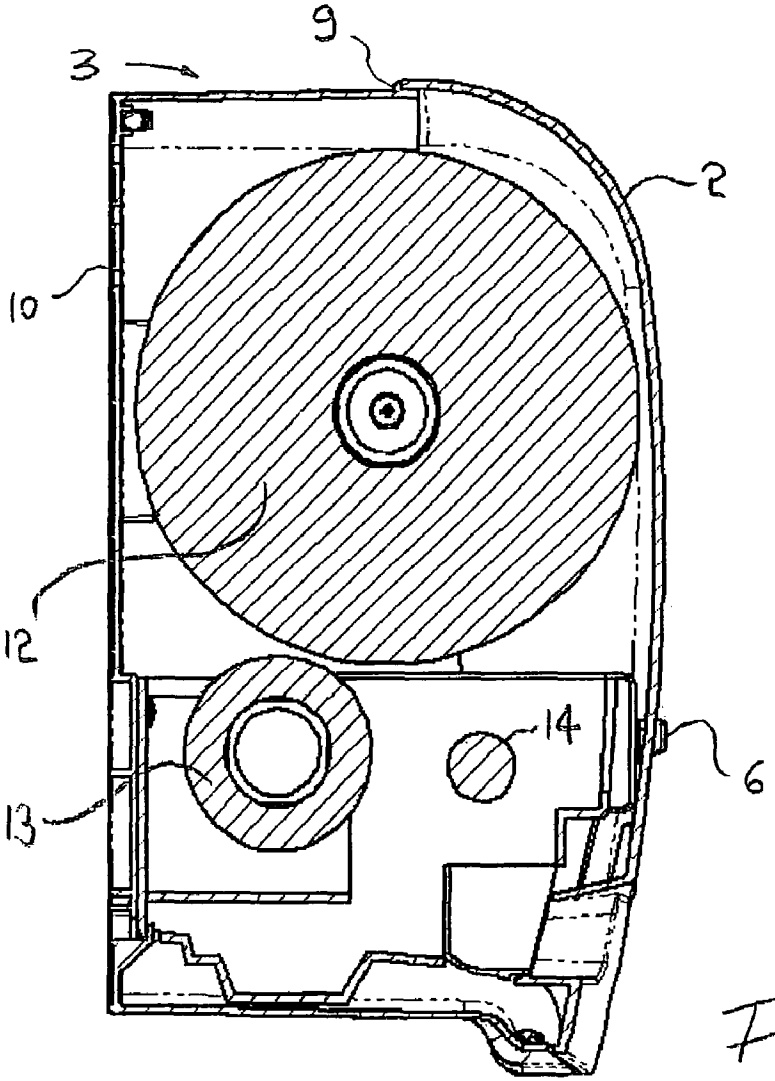
FIG. 3 is a sectional view seen from the same side as in FIG. 2.

FIG. 3 shows how the dispenser according to the invention accommodates a little more than half of an eight-inch roll 12 of absorbent sheet products in the body portion 3, with a little less than half of the roll diameter projecting into the cover portion 2. Element 13 in FIG. 3 is a stub roll, that is, a mostly used-up roll that will be dispensed with the first part of the fresh roll 12, whereas 14 is the shaft of the dispensing roller.

Figure 4:
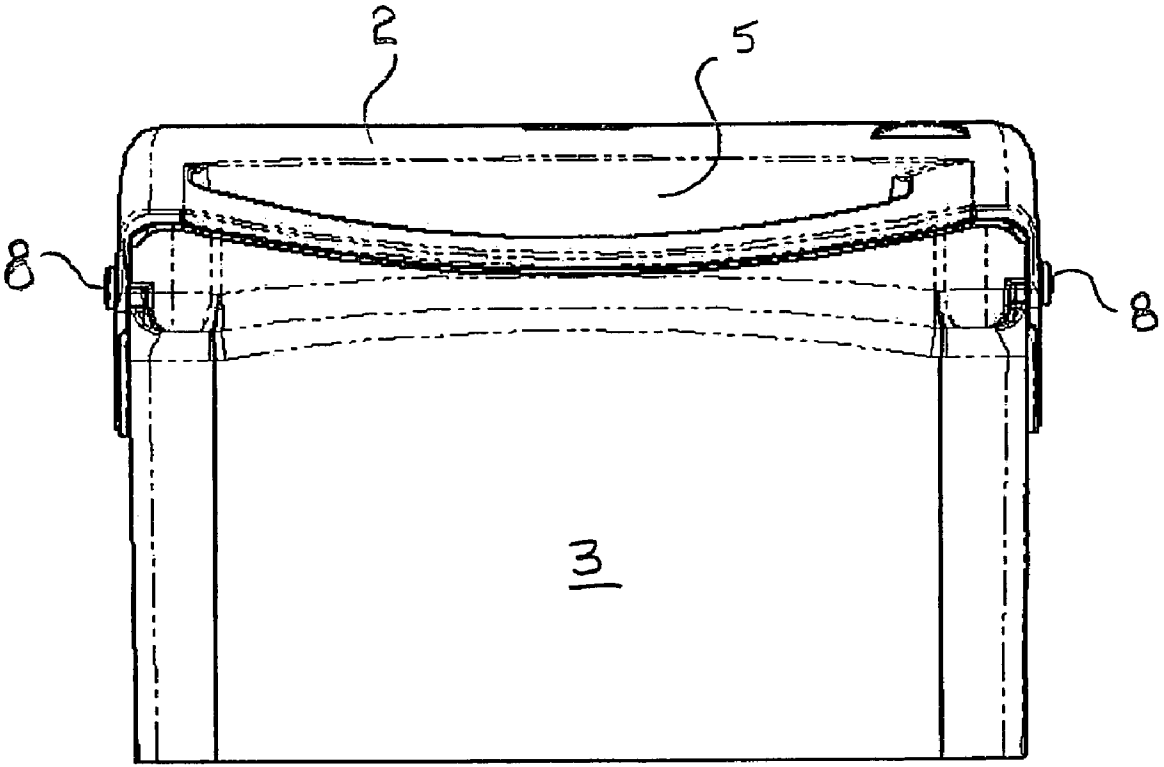
FIG. 4 is a view from the underside of the dispenser of FIG. 1.

In FIG. 4, the dispensing opening 5 and hinge structures 8 are more clearly visible as shown from below.

Figure 5:
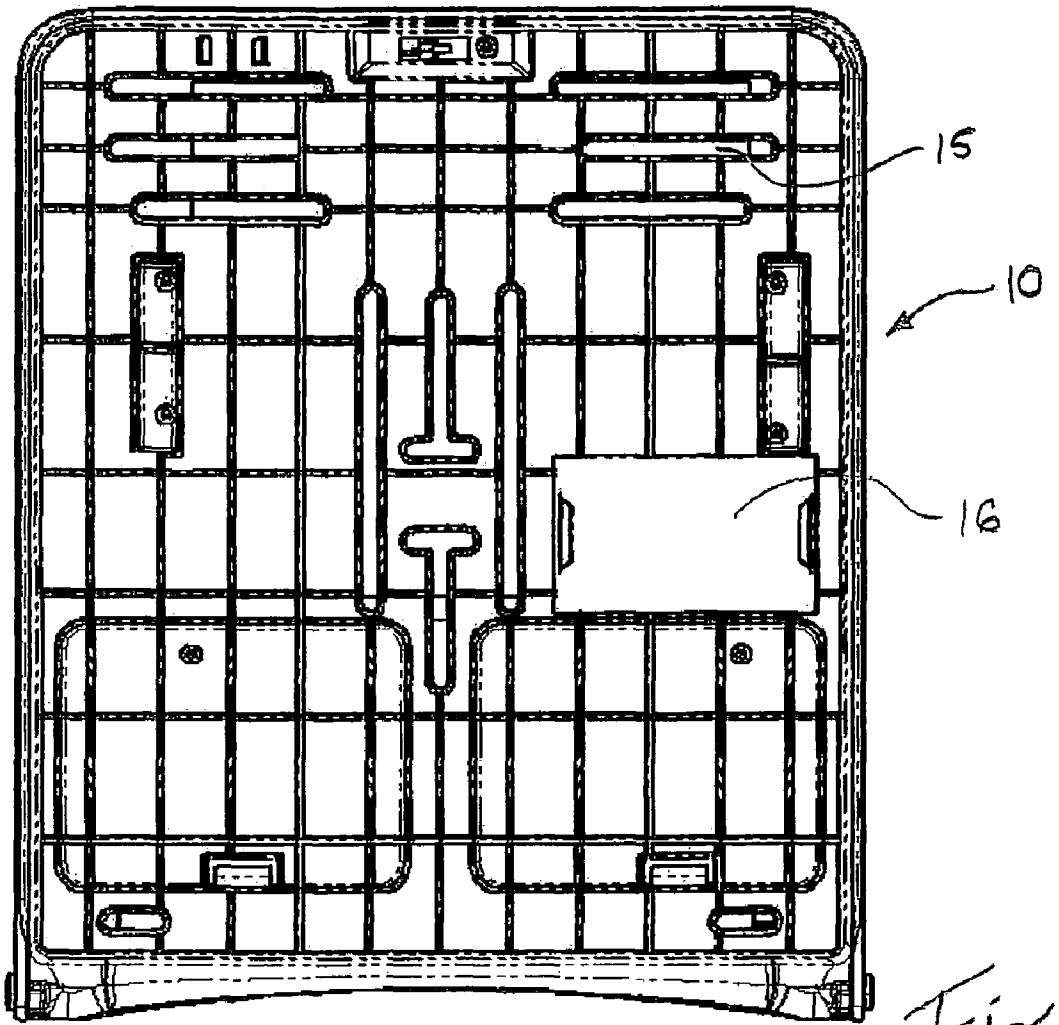
FIG. 5 is a view of the rear mounting surface of the dispenser of FIG. 1.

In FIG. 5, the rear mounting surface 10 is shown in detail. A variety of elongated openings 15 are provided, which provide flexibility in mounting the dispenser whether in a wall mount or recess mount application. Element 16 is a business card holder integrally molded with the rear mounting surface of the dispenser body and facing inwardly of the dispenser. This permits the salesman who places the dispenser to leave his card in the dispenser itself, not viewable by customers, but easily accessible to the proprietor of the establishment in which the dispenser is placed, when he or she goes to replace a roll of sheet material.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A dispenser for dispensing absorbent sheet products from a roll to be disposed within said dispenser, said dispenser comprising a dispenser body and a cover; the dispenser body comprising a rear portion comprising top, bottom and side surfaces and a rear mounting surface, the rear portion being adapted to at least partially receive a roll of absorbent sheet products to be disposed within said dispenser, such a roll having a diameter of at least about six inches, said dispenser body further comprising a flange along at least one of said top, bottom and side surfaces of said rear portion, said flange projecting outwardly from said rear portion, a first hinge structure and a first lock structure; said cover comprising a second hinge structure engaging said first hinge structure to secure the cover to the dispenser body while permitting the cover to be opened for service of said dispenser or replacement of a roll of absorbent sheet products therein, and a second lock structure adapted to engage the first lock structure to secure the cover in a closed position with at least one edge of said cover contacting said flange, wherein said cover has a horizontal projection not exceeding about four inches when said cover is closed and when said dispenser is oriented with said rear mounting surface disposed vertically, said top, bottom and side surfaces of said rear portion of said dispenser body being outwardly free of sharp edges and being joined by outwardly rounded corners, said cover having side edges adjacent said flange, said side edges and said flange extending toward a front of said dispenser over a majority of a length of said cover from a top of said cover to a bottom of said cover, so that said cover is able to be opened a full 180° even when the dispenser is recess mounted.

2. The dispenser according to claim 1, wherein said dispenser body is made from injection-molded plastic.

3. The dispenser according to claim 1, wherein said cover is made from injection-molded plastic.

4. The dispenser according to claim 3, wherein said cover is opaque or translucent over most of its surface area, and comprises a transparent window formed therein.

5. The dispenser according to claim 4, wherein said opaque surfaces of said cover and said window are co-formed by two-shot injection molding.

6. The dispenser according to claim 1, wherein said rear portion of said dispenser body is generally parallelepiped, with said side surfaces being generally parallel to one another, said top and bottom surfaces being generally parallel to each other, said top and bottom surfaces being generally perpendicular to said side surfaces, and said rear mounting surface being generally perpendicular to said top, bottom and side surfaces.

7. The dispenser according to claim 1, wherein said cover has a generally lenticular shape as viewed from the side.

8. The dispenser according to claim 1, wherein said first and second hinge structures comprise bosses formed on said dispenser body that fit within openings formed on said cover.

9. The dispenser according to claim 1, wherein said first and second hinge structures are located adjacent bottom side corners of said dispenser body and said cover, respectively.

10. The dispenser according to claim 1, wherein said flange is located along said top surface of said rear portion of said dispenser body.

* * * * *